US011167349B2

(12) United States Patent
Dubach et al.

(10) Patent No.: US 11,167,349 B2
(45) **Date of Patent: *Nov. 9, 2021**

(54) PART COATING METHOD

(71) Applicant: The Swatch Group Research and Development Ltd, Marin (CH)

(72) Inventors: Alban Dubach, Bienne (CH); Yves Winkler, Schmitten (CH)

(73) Assignee: The Swatch Group Research and Development Ltd, Marin (CH)

( * ) Notice: Subject to any disclaimer, the term of this patent is extended or adjusted under 35 U.S.C. 154(b) by 503 days.

This patent is subject to a terminal disclaimer.

(21) Appl. No.: 15/741,310

(22) PCT Filed: Jul. 20, 2016

(86) PCT No.: PCT/EP2016/067292

§ 371 (c)(1),
(2) Date: Jan. 2, 2018

(87) PCT Pub. No.: WO2017/016951

PCT Pub. Date: Feb. 2, 2017

(65) Prior Publication Data

US 2018/0193919 A1 Jul. 12, 2018

(30) Foreign Application Priority Data

Jul. 24, 2015 (EP) ..... 15178288

(51) Int. Cl.
*B22D 25/00* (2006.01)
*B22F 3/11* (2006.01)
(Continued)

(52) U.S. Cl.
CPC ..... *B22F 3/1125* (2013.01); *B22D 19/04* (2013.01); *B22D 23/06* (2013.01); *B22F 7/006* (2013.01); *C22C 1/002* (2013.01); *G04B 37/22* (2013.01); *G04B 37/226* (2013.01); *B22D 25/005* (2013.01)

(58) Field of Classification Search
None
See application file for complete search history.

(56) References Cited

U.S. PATENT DOCUMENTS

2006/0141894 A1 6/2006 Hippke et al.
2006/0254742 A1* 11/2006 Johnson ..... B22D 25/005 164/79

(Continued)

FOREIGN PATENT DOCUMENTS

CH 352966 A 3/1961
DE 199 08 867 A1 9/2000

(Continued)

OTHER PUBLICATIONS

International Search Report dated Nov. 9, 2016, in PCT/EP2016/067292 filed Jul. 20, 2016.

*Primary Examiner* — George Wyszomierski
(74) *Attorney, Agent, or Firm* — Oblon, McClelland, Maier & Neustadt, L.L.P.

(57) ABSTRACT

A device including a first portion made of a first material and a second portion made of a second material, the second part extends from one of faces of the first portion and is made of an amorphous material.

12 Claims, 2 Drawing Sheets

(51) Int. Cl.

| | |
|---|---|
| ***B22F 7/00*** | (2006.01) |
| ***G04B 37/22*** | (2006.01) |
| ***B22D 23/06*** | (2006.01) |
| ***B22D 19/04*** | (2006.01) |
| ***C22C 1/00*** | (2006.01) |

(56) References Cited

U.S. PATENT DOCUMENTS

| | | | | |
|---|---|---|---|---|
| 2007/0048164 | A1 | 3/2007 | Demetriou et al. | |
| 2007/0290339 | A1 | 12/2007 | Suh et al. | |
| 2009/0196125 | A1* | 8/2009 | Tsuchiya | G04B 13/02<br>368/322 |
| 2011/0079940 | A1* | 4/2011 | Schroers | C22C 16/00<br>264/535 |
| 2014/0112112 | A1 | 4/2014 | Plankert et al. | |

FOREIGN PATENT DOCUMENTS

| | | | |
|---|---|---|---|
| DE | 199 12 618 | A1 | 9/2000 |
| DE | 199 28 997 | A1 | 1/2001 |
| DE | 10 2008 060 234 | A1 | 6/2010 |
| EP | 1 677 332 | A2 | 12/2005 |
| EP | 2 725 000 | A1 | 4/2014 |
| EP | 2 835 698 | A1 | 2/2015 |

* cited by examiner

PART COATING METHOD

The present invention concerns a device including a first part made from a first material and at least one second part made from a second material, characterized in that the second part is made from a foam and assembled to the first part.

The technical field of the invention the field of precision mechanical engineering.

TECHNOLOGICAL BACKGROUND

There exist numerous methods for producing a coating on a first part. The known methods generally consist in depositing a layer of the required material by electrodeposition.

However, electrodeposition has the drawback of enabling, the deposition of only thin coatings, which is reflected in a low impact resistance.

The impacts applied to said part then lead to marking of the coating diminishing the esthetic aspect of the part and degrading the performance of the coating.

Another solution consists in using a metal foil and fixing this metal foil to the part to be coated serving as a substrate. Fixing is achieved by gluing or welding or brazing or force-fitting.

A drawback of this method is that it is not suitable for materials that are fragile of the silicon type.

SUMMARY OF THE INVENTION

An object of the invention is to elevate the drawbacks of the prior art by proposing a method for coating a part simply and reliably with no limitation as to the nature of the parts fixed together.

To this end, the invention concerns a method of manufacturing a part consisting of a first portion made of a first material and a second portion made of a second material, characterized in that said method further includes the following steps:

procuring a preform made of the second material, said second material being an at least partially amorphous metal adapted to become a foam subject to temperature and pressure conditions;

procuring said first portion and placing said first portion and the preform between two dies having the negative shape of the part to be manufactured;

heating the combination to a temperature between the glass transition temperature Tg and the crystallization temperature Tx inclusive of the preform in order, at the latest during this step, to enable the preform to form a foam and to enable expansion of said preform in order to fill the negative shape of the device and form said part;

cooling the combination to solidify the preform and separate the device from the dies.

In a first embodiment of the invention, the expansion of the preform is used to form a coated part.

In a second embodiment of the invention, the expansion of the preform is used to form a bimaterial part.

In a third embodiment, of the invention, the first portion includes at least one cavity into which the amorphous metal foam forming the second part extends.

In a fourth embodiment of the invention, the first portion includes at least one protuberance (15) around which the amorphous metal foam forming the second part extends.

In a fifth embodiment of the invention, the first part includes structures (14) enabling better attachment of the second part.

In another embodiment of the invention, the method includes a preliminary step of fabrication of an at least partially amorphous metal alloy foam preform.

In another embodiment of the invention, the expansion of the foam is controlled by temperature, the higher the temperature the greater the expansion.

In another embodiment of the invention, the expansion of the foam depends on the gas density in the foam, the greater the trapped gas volume the greater the expansion.

In another embodiment of the invention, the expansion is produced by making the pressure in the foam greater than atmospheric pressure.

The invention also concerns a device including a first portion made of a first material and a second portion made of a second material, characterized in that the second part extends from one of the faces of the first portion and is made of an at least partially amorphous metal alloy foam.

In a first embodiment of the invention, the second part is a coating.

In a second embodiment of the invention, the second part enables formation of a bimaterial part.

In a third embodiment of the invention, the first part includes at least one cavity into which the amorphous metal foam forming the second, part extends.

In a fourth embodiment of the invention, the first part includes at least one protuberance around which the amorphous metal foam forming the second part extends.

In a fifth embodiment of the invention, the first part includes structures into which the amorphous metal foam forming the second part extends.

BRIEF DESCRIPTION OF THE FIGURES

The objects, advantages and features of the method according to the present invention will become more clearly apparent in the following detailed description of at least one embodiment of the invention given by way of nonlimiting example only and illustrated by the appended drawings, in which.

DETAILED DESCRIPTION

The present invention concerns a device and its method of assembly, the device comprising a first part and at least one second part.

Figure 1:
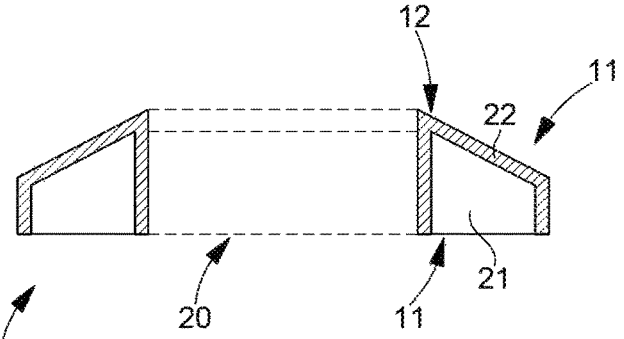
FIG. 1 represents diagrammatically a device according to a first embodiment of the invention.

In a first embodiment of the invention that can be seen in FIG. 1, the device 10 includes a first portion 11 and a second portion 12. The first portion 11 is made of a first material and the second portion 12 is made of a second material.

According to this first embodiment, the first portion or the second portion advantageously takes the form of an at least partially amorphous metal foam including at least one metal element such as an at least partially amorphous metal, alloy.

This metal element can be a classic metal element such as iron, nickel, zirconium, or a precious metal such as gold, platinum, palladium, rhenium, ruthenium, rhodium, silver, iridium or osmium. By an at least partially amorphous material is meant a material adapted to solidify at least partially in an amorphous phase, i.e. subjected to a temperature increase above its melting point enabling it locally to lose all crystalline structure, said increase being followed by cooling to a temperature below its glass transition temperature enabling it to become at least partially amorphous.

A foam of this kind can be produced using various techniques. A first method consists in procuring an alloy and heating it until it reaches a liquid state. At this time gas bubbles are injected into said alloy in the liquid state. This injection of gas bubbles occurs before a step of rapid cooling. This rapid cooling step is carried out to solidify said alloy whilst trapping the gas bubbles.

A second method for producing a foam of this kind consists in procuring an alloy and heating it until it reaches a liquid state. At this time chemical agents are injected into said alloy in the liquid state. These chemical agents are agents releasing gas so that the latter, under certain conditions, release gases. These chemical agents or precursors can, be hydrides of titanium or zirconium, for example. This release of gas occurs before a step of rapid cooling. This rapid cooling step is carried out to solidify said alloy whilst trapping the gas bubbles.

A variant of this second method consists in providing a material adapted to become a foam in order to obtain a material that becomes an amorphous metal foam only at the time of shaping it. In fact, the chemical agents used are release agents that release gases under certain conditions of temperature and pressure. Accordingly, by increasing the pressure during, cooling, the release of the gas is contained. During shaping, the temperature rise enables the release of the gas and therefore the transformation of the material into foam.

A third method for producing an amorphous metal foam consists in successive deposition of layers of powder, each layer of powder being sintered locally by a laser or electron beam. This local sintering therefore makes it possible to create the pores that will make it possible to form the foam at the level of each layer of powder.

This advantageously makes it possible to produce coated parts or bimaterial parts, the second portion 12 is then a coating or an integral part of the first portion 11.

In fact, for parts made of fragile materials like silicon, it can be useful to have parts coated with or made from a material that is stronger or has more favorable mechanical properties or to put it bluntly having an entire portion of the part that is produced in another material. This embodiment also makes it possible simply to produce the second part and to assemble it to the first part in a single process.

When a part is coated with the amorphous metal foam, there will be considered the example of a bezel 21 serving as the first portion 11, coated with a layer 22 of foam serving as the second portion 12 forming a coated part 20 that is the finished device 10 as can be seen in FIG. 1. The first material can be a material classically used such as steel, brass, aluminum or titanium but can equally well be a material termed fragile. By a fragile material is meant a material that has no usable plastic range such as for example quartz, ruby, sapphire, glass, silicon, graphite, carbon or a ceramic such as silicon carbide and silicon nitride or a ceramic type composite material.

A first step of the method consists in procuring an amorphous metal foam preform 23.

Figure 2:
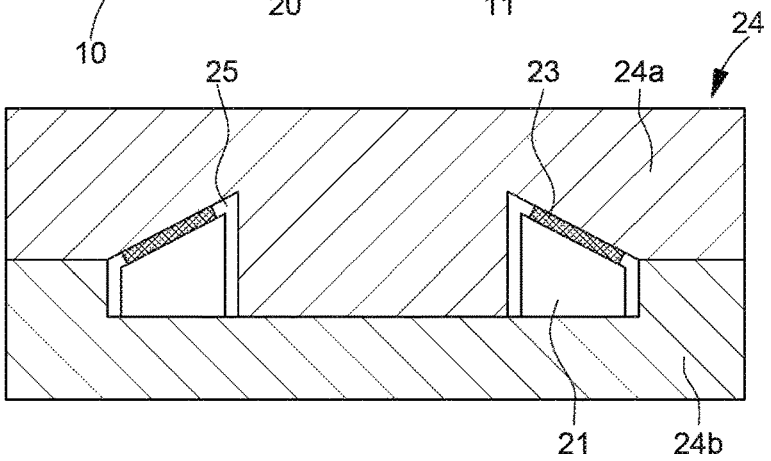
FIGS. 2 to 4 represent diagrammatically the method of assembling a device according to a first embodiment of the invention.

A second step consists in procuring the portion to be coated, here the bezel 21, and to place it in a mold 24 that can consist of dies 24*a*, 24*b* having the negative shape of the coated part as can be seen in FIG. 2. This mold can be formed of two dies. The preform 23 is also placed in the mold.

For example, if it is required to coat the whole surface of a bezel or a gear train with a 0.1 millimeter amorphous metal foam layer, the mold will have the shape of the gear train or the bezel and dimensions equal to the dimensions of the gear train plus the 0.1 millimeter of the layer. There therefore exists a space 25 to be filled.

In a third step, a heating step is carried out. This heating step consists in heating the combination to a temperature between the glass transition temperature Tg and the crystallization temperature Tx inclusive of the preform. At this temperature amorphous metals have a viscosity that decreases strongly, the decrease in the viscosity being dependent on temperature: the higher the temperature, the more the viscosity decreases. This viscosity enables the amorphous metal, when subjected to a stress, to be inserted into all the corners of a mold.

Figure 3:
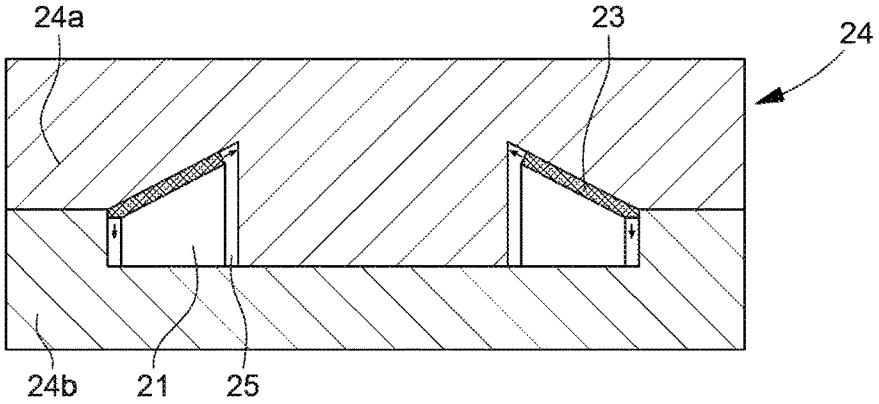
Figure 4:
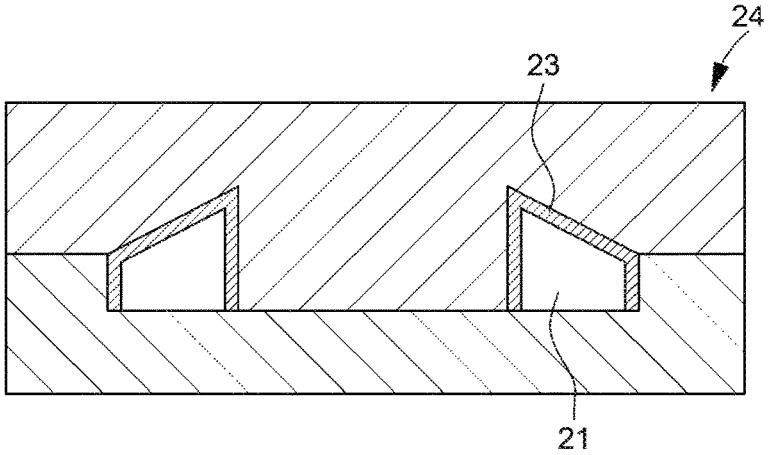

This increase in temperature also makes it possible to heat the gas bubbles present in the foam preform. Now, a heated gas begins to expand with the result that it will occupy a greater volume. Given that the amorphous metal of the foam is in a state termed viscous, this expansion of the gas causes an expansion of the foam preform, this preform begins to swell up as can be seen in FIG. 3. Consequently, the volume occupied by the preform increases. This increase in the volume of the preform associated with the shaping characteristics of amorphous metals leads to filling of the mold as can be seen in FIG. 4.

To enable the expansion of the amorphous metal foam preform, it is necessary that the pressure in the negative be less than the pressure of the gas inside the preform as otherwise there can be no expansion there. In the case of a sealed mold, it would be astute to establish a vacuum in the cavity formed by the two dies. If the two dies form a non-sealed mold, the enclosure in which the mold is located will be subjected to a vacuum or to a pressure sufficiently lower than the pressure of the gas.

Similarly, to prevent the stress exerted by the expansion of the preform leading to desolidarization of the two dies of the mold, these two dies can be fixed together by fixing means such as bolts or simply by exerting pressure on them.

It is possible to produce foaming with a controllable viscosity, i.e. by adjusting the temperature between Tg and Tx it is possible to modify the viscosity of the alloy so that the expansion is faster or slower.

As the glass transition temperature Tg and the crystallization temperature Tx are lower than the melting point of said foam, this makes it possible to assemble parts with melting points lower than the melting point of the metal foam.

Finally, given that the melting point of the foam is not exceeded, the connection remains purely mechanical and no welding occurs, i.e. there is no risk of creating unwanted phases (for example fragile intermetallic phases).

Once the expansion of the preform has been completed, a cooling step is carried, out. This cooling step is carried out to fix the amorphous metal foam preform and to form the intermediate part. The device is then separated from the dies to obtain the device from FIG. 1.

Figure 5:
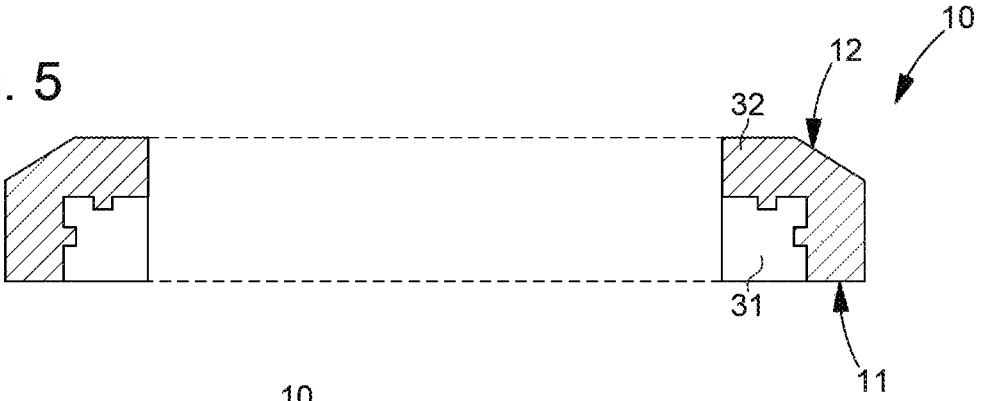
FIGS. 5 and 6 represent diagrammatically a variant of the device according to the first embodiment of the invention.

When a part is a bimaterial part, it will be clear that the finished part is composed of a first portion 11 in any material and a second portion 12 in amorphous metal foam. A first step of the method consists in procuring an amorphous metal foam preform. For example, this may be a bimaterial bezel consisting of a base 31 serving as the first portion 11 on a second portion 12 in a second material. The second portion 12 then forms an external shell 32 of the bezel as can be seen in FIG. 5.

Figure 6:
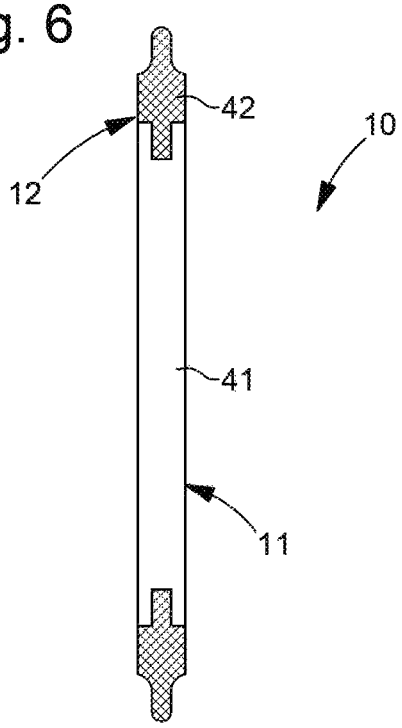

In another example, the finished part 10 could be a shaft 41 the reduced diameter end portions 42 of which are made from a second material as can be seen in FIG. 6.

In these two examples, it will be clear that the first portion or the second portion can be in amorphous metal foam.

These two examples highlight the advantage of a bimaterial part, which is to be able to select the material according to the use that is made thereof.

A second step consists in procuring the first portion 11 of the material part and to place it in a mold having, the shape and the dimensions of the finished part.

In this second step, the preform is also placed in the mold. The preform has a shape similar to that of the second portion.

In a third step, a heating step is carried out. This heating step consists in, heating the combination to a temperature between the glass transition temperature Tg and the crystallization temperature Tx inclusive of the preform. At this temperature amorphous metals have a viscosity that decreases strongly, the decrease in the viscosity being dependent on temperature: the higher the temperature, the more the viscosity decreases. This viscosity enables the amorphous metal to be inserted into all the corners of a mold. This increase in temperature also makes it possible to heat the gas bubbles present in the foam preform.

Now, a heated gas begins to expand with the result that it will occupy a greater volume. Given that the amorphous metal of the foam is in a state termed viscous, this expansion of the gas causes expansion of the foam preform, this preform begins to swell up. Consequently, the volume occupied by the preform increases. This increase in the volume of the preform associated with the shaping characteristics of amorphous metals leads to filling of the mold i.e. filling of the space dedicated to the second portion of the finished part.

Once the expansion of the preform has been completed, a cooling step is carried out. This cooling step is carried out to fix the amorphous metal foam, preform and to form the intermediate part.

Figure 7:
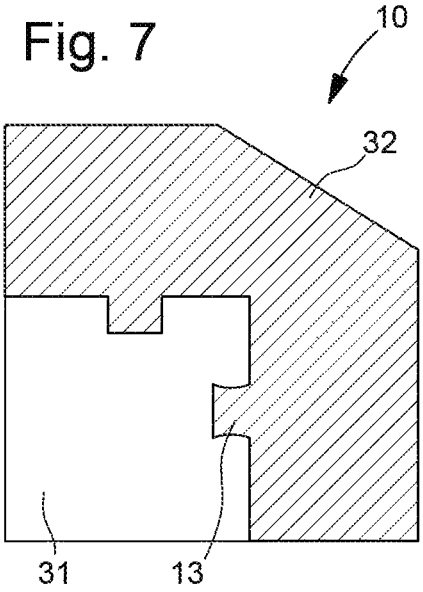
FIGS. 7 to 9 represent diagrammatically various embodiments of the invention.

In a variant of this first embodiment seen in FIG. 7, the first part 1 of the finished part including a cavity 13 can be envisaged. This cavity 13 is used to improve the bond between the first part 31 and the second part 32 when the second part 32 is a coating or is used to form a bimaterial part. Producing a cavity 13 during manufacture enables the amorphous metal foam to expand into it to strengthen the bond between the first part and the second part.

Figure 8:
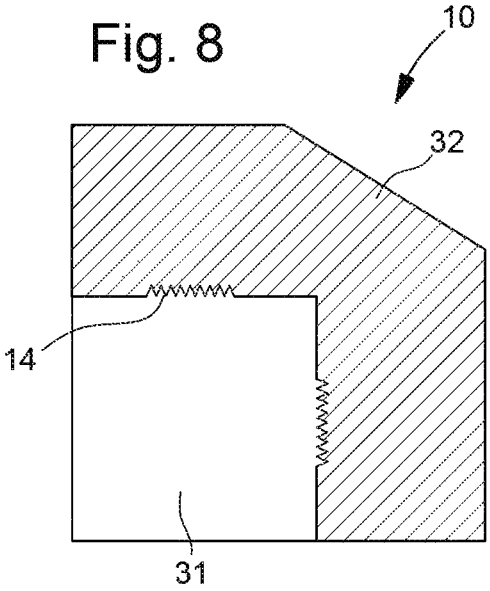

If appropriate this cavity can include or be replaced by structures 14 that increase the roughness and therefore the attachment as can be seen in FIG. 8.

In an alternative to the first variant of the first embodiment, the cavity is adapted to have a shape such that its area is not constant. This means that the cavity does not have a profile that is constant as a function of depth. The profile of the cavity will ideally widen as a function of depth so as to create natural retention.

In a variant of the method of the various embodiments, the preform becomes a foam only during the third step. In fact, when the foam uses precursor chemical agents that release gas as a function of temperature, it has been described above that the alloy containing these precursor chemical agents could be cooled before they release the gas making it possible to obtain a preform that is not in the form of a foam.

This possibility makes possible a method in which the step of transformation of the foam preform and the step of expansion of said foam occur at the same time. This is made possible because the release of the gas by the precursor chemical agents and the expansion of the foam occur when the material is heated.

Consequently, the method consists in procuring the preform not taking the form of a foam and placing it in the mold. The combination is then heated to a temperature enabling the precursor chemical agents to release the gas, this temperature also enabling the gases to expand and to lead to an expansion of the material.

In the various embodiments, the expansion of the amorphous metal foam preform can be controlled in various ways.

A first solution consists in modifying the density of the gas bubbles during the manufacture of the foam. One method of manufacturing amorphous metal foam consists in injecting gas bubbles into the molten metal and cooling it to trap these bubbles. The injection of gas bubbles can be controlled so that they are distributed in a more or less homogeneous and more or less dense manner. It will then be clear that the greater the density of the gas bubbles the greater the volume of gas enclosed in the foam. Now, the greater the enclosed gas volume the greater the expansion caused by the expansion of the gas during the heating stage.

A second solution consists in controlling the expansion of the amorphous metal foam by modifying the temperature in the heating step. Effectively, when a gas is heated, the quantity of movement of the particles that constitute it increases. At constant volume, this is reflected in an increase of the pressure, because the number of impacts between particles per unit area increases. If the pressure must remain constant, the volume of the gas must then increase, in accordance with the perfect gas laws. Consequently, the volume of the gas enclosed in the amorphous metal foam is varied and its expansion is therefore modified by increasing or decreasing the heating temperature during the heating step.

In a third solution the expansion of the amorphous metal foam is controlled by controlling the atmosphere in the heating enclosure in the second embodiment or in the cavity of the mold in the first embodiment. This solution starts from the principle that the expansion is possible from the moment at which the pressure of the gas enclosed in the amorphous metal foam is greater than that of the atmosphere outside the foam. The idea is that the outside atmosphere is close to a vacuum so as to encourage as much as possible the expansion of the foam. By virtue of this fact, by adjusting the external pressure, the amplitude of the expansion of said foam is adjusted given that the higher the pressure of the outside atmosphere the less the expansion will be.

It will be clear that various modifications and/or improvements and/or combinations obvious to the person skilled in the art can be made to the various embodiments of the invention described above without departing from the scope of the invention defined by the appended claims.

Figure 9:
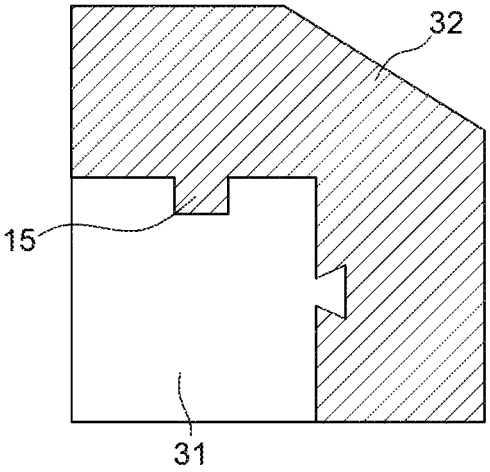

Of course, replacing the cavities with or adding to the cavities protuberances 15 as seen in FIG. 9 can be envisaged. These protuberances are the negatives of the cavities and have the same function.

This means that the amorphous metal foam is shaped so as to be able to envelop this protuberance or these protuberances and to improve the fastening together of the first portion and the second portion.

The invention claimed is:

1. A method of manufacturing a device comprising a first part including a first portion made of a first material and a second portion made of a second material, the method comprising:

procuring a preform made of the second material, the second material being an at least partially amorphous metal adapted to increase in volume subject to temperature and pressure conditions;

procuring the first portion and placing the first portion and the preform between two dies of a mold, the two dies having a negative shape of a part to be manufactured, to obtain a combination;

heating the combination to a temperature between the glass transition temperature and the crystallization temperature inclusive of the preform, at a latest during the heating, whereby the preform forms an at least partially amorphous metal foam and expands to fill the negative shape of the device and form the first part, cooling the combination to solidify the preform to retain the at least partially amorphous metal foam state and separate the device from the dies, wherein the expansion of the amorphous metal foam is enabled by making pressure in the negative shape be less than the pressure of gas inside the preform, wherein one of the following is satisfied:

(i) the mold is a sealed mold, and the expansion of the amorphous metal foam is enabled by establishing a vacuum in a cavity formed by the two dies; or (ii) the two dies form a non-sealed mold, and an enclosure in which the mold is located is subjected to a vacuum or to a pressure sufficiently lower than the pressure of the gas to enable expansion of the amorphous metal foam.

2. The method of manufacture as claimed in claim 1, wherein the expansion of the preform is used to form a coated part.

3. The method of manufacture as claimed in claim 1, wherein the expansion of the preform is used to form a bimaterial part.

4. The method of manufacture as claimed in claim 1, wherein the first portion includes at least one cavity into which the amorphous metal foam forming a second part extends.

5. The method of manufacture as claimed in claim 1, wherein the first portion includes at least one protuberance around which the amorphous metal foam forming a second part extends.

6. The method of manufacture as claimed in claim 1, wherein the first part includes structures enabling better attachment of a second part.

7. The method of manufacture as claimed in claim 1, further comprising a preliminary fabrication of an at least partially amorphous metal alloy foam preform.

8. The method of manufacture as claimed claim 1, wherein the expansion of the foam is controlled by temperature, the higher the temperature the greater the expansion.

9. The method of manufacture as claimed in claim 1, wherein the expansion of the foam depends on gas density in the foam, the greater the trapped gas volume the greater the expansion.

10. The method of manufacture as claimed in claim 1, wherein the expansion is produced by making pressure in the foam greater than ambient pressure.

11. The method of manufacture as claimed in claim 1, wherein (i) the mold is a sealed mold, and the expansion of the amorphous metal foam is enabled by establishing a vacuum in a cavity formed by the two dies.

12. The method of manufacture as claimed in claim 1, wherein (ii) the two dies form a non-sealed mold, and an enclosure in which the mold is located is subjected to a vacuum or to a pressure sufficiently lower than the pressure of the gas to enable expansion of the amorphous metal foam.

* * * * *